US010494744B2

(12) United States Patent
Steffen et al.

(10) Patent No.: US 10,494,744 B2
(45) Date of Patent: Dec. 3, 2019

(54) SELF-CRIMPED RIBBON FIBER AND NONWOVENS MANUFACTURED THEREFROM

(71) Applicant: AVINTIV Specialty Materials Inc., Charlotte, NC (US)

(72) Inventors: John Frederick Steffen, Denver, NC (US); Ralph A. Moody, III, Mooresville, NC (US)

(73) Assignee: AVINTIV Specialty Materials, Inc., Charlotte, NC (US)

( * ) Notice: Subject to any disclaimer, the term of this patent is extended or adjusted under 35 U.S.C. 154(b) by 267 days.

(21) Appl. No.: 14/821,432

(22) Filed: Aug. 7, 2015

(65) Prior Publication Data

US 2016/0040323 A1 Feb. 11, 2016

Related U.S. Application Data

(60) Provisional application No. 62/034,460, filed on Aug. 7, 2014.

(51) Int. Cl.
*D02G 3/34* (2006.01)
*D02G 1/00* (2006.01)
(Continued)

(52) U.S. Cl.
CPC ..... *D02G 3/34* (2013.01); *D01D 5/08* (2013.01); *D01D 5/22* (2013.01); *D01F 8/04* (2013.01);
(Continued)

(58) Field of Classification Search
CPC .. D01D 5/22; D01D 5/23; D01D 5/30; D01D 5/32; D01D 5/34; D01D 5/36;
(Continued)

(56) References Cited

U.S. PATENT DOCUMENTS 4,002,795 A * 1/1977 Barbe ..... D01D 5/32 428/369
4,551,378 A * 11/1985 Carey, Jr. ..... D04H 1/06 156/308.2
(Continued)

FOREIGN PATENT DOCUMENTS

JP 2586125 B2 2/1997
JP 2001519488 A 10/2001
(Continued)

OTHER PUBLICATIONS

Spunbond definition, Textile Glossary, Celanese Acetate, copyright 2001 (Year: 2001).*
(Continued)

*Primary Examiner* — Jennifer A Steele
(74) *Attorney, Agent, or Firm* — Burr Forman McNair LLP

(57) ABSTRACT

Multi-component fibers or filaments that are ribbon shaped are provided having polymer components positioned in a side-by-side fashion. For example, the multi-component fibers may be bicomponent fibers having ribbon shape. The polymer components of the fibers are selected to have differential shrinkage behavior. Nonwovens are also provided that are manufactured from such ribbon shaped multi-component fibers or filaments.

17 Claims, 5 Drawing Sheets

(51) Int. Cl.

| | |
|---|---|
| ***D04H 3/018*** | (2012.01) |
| ***D01F 8/14*** | (2006.01) |
| ***D01D 5/22*** | (2006.01) |
| ***D01D 5/08*** | (2006.01) |
| ***D04H 1/492*** | (2012.01) |
| ***D04H 1/541*** | (2012.01) |
| ***D04H 1/4382*** | (2012.01) |
| ***D01F 8/04*** | (2006.01) |
| ***D04H 3/147*** | (2012.01) |
| ***D04H 3/11*** | (2012.01) |

(52) U.S. Cl.

CPC ..... *D01F 8/14* (2013.01); *D02G 1/004* (2013.01); *D04H 1/4382* (2013.01); *D04H 1/492* (2013.01); *D04H 1/541* (2013.01); *D04H 3/018* (2013.01); *D04H 3/11* (2013.01); *D04H 3/147* (2013.01)

(58) Field of Classification Search

CPC ..... D01D 5/253; D02G 1/004; D02G 1/18; D04H 1/06; D04H 1/067; D04H 1/073; D04H 1/50; D04H 1/541; D01F 8/00; D01F 8/04–16; Y10T 428/2909; Y10T 428/2922; Y10T 428/2924; Y10T 428/2925; Y10T 428/2929; Y10T 428/2931; Y10T 428/2973; Y10T 428/2978; Y10T 442/609; Y10T 442/611; Y10T 442/627; Y10T 442/629; Y10T 442/632; Y10T 442/633; Y10T 442/634; Y10T 442/635; Y10T 442/636; Y10T 442/637; Y10T 442/638; Y10T 442/641

USPC ..... 428/362, 369, 370, 371, 373, 374, 397, 428/400; 442/334, 337, 352, 353, 356, 442/357, 359, 360–364

See application file for complete search history.

(56) References Cited

U.S. PATENT DOCUMENTS

| | | | | |
|---|---|---|---|---|
| 5,622,772 | A * | 4/1997 | Stokes | D01F 8/06 428/369 |
| 5,698,300 | A | 12/1997 | Wimmer et al. | |
| 6,562,457 | B1 | 5/2003 | Goldfinger et al. | |
| 6,627,025 | B1 | 9/2003 | Yu | |
| 6,656,586 | B2 * | 12/2003 | Hartzog | D01D 5/253 428/373 |
| 7,195,819 | B2 * | 3/2007 | Hietpas | D01D 5/253 428/359 |
| 7,994,081 | B2 | 8/2011 | Farell et al. | |
| 8,758,660 | B2 | 6/2014 | Kurian et al. | |
| 9,919,131 | B2 | 3/2018 | Birchard et al. | |
| 2003/0118816 | A1 * | 6/2003 | Polanco | D04H 1/50 428/369 |
| 2006/0223405 | A1 | 10/2006 | Pourdeyhimi et al. | |
| 2007/0071974 | A1 * | 3/2007 | Hietpas | D01D 5/253 428/375 |
| 2013/0041335 | A1 | 2/2013 | Dwiggins et al. | |
| 2014/0066873 | A1 * | 3/2014 | Kawakami | D04H 1/541 604/367 |
| 2014/0110354 | A1 * | 4/2014 | Haberkamp | B01D 39/163 210/767 |

FOREIGN PATENT DOCUMENTS

| | | | |
|---|---|---|---|
| RU | 2435881 | C1 | 12/2011 |
| WO | 9919131 | A1 | 4/1999 |
| WO | 1999019131 | A1 | 4/1999 |
| WO | 2007035740 | A2 | 3/2007 |

OTHER PUBLICATIONS

International Search Report from PCT/US2015/0044322 dated Oct. 6, 2015.

Second Written Opinion of corresponding international application No. PCT/US2015/044322, dated Oct. 5, 2016, all enclosed pages cited.

Second Written Opinion of the International Preliminary Examining Authority in corresponding International Application No. PCT/US2015/044322, dated Dec. 23, 2016, all enclosed pages cited.

Office Action of corresponding Colombian Application No. NC2017/0001962 dated Jul. 9, 2018, all enclosed pages cited.

Office Action of corresponding Chilean Application, No. 296-2017dated Oct. 3, 2018, all enclosed pages cited.

Office Action of corresponding Chinese Application, No. 20150054656.4 dated Sep. 3, 2018, all enclosed pages cited.

English Translation of Second Substantive Examination Report in Colombian Patent Application No. NC2017/0001962, dated Feb. 9, 2019, all enclosed pages cited.

Communication from Mexico counsel dated Aug. 6, 2019 regarding Office Action issued in Mexican Application No. MX/a/2017/001768, all enclosed pages cited.

Communication pursuant to Article 94(3) EPC in European Application No. 15 753 277.1 dated Sep. 24, 2019, all enclosed pages cited.

Notification of Reasons for Refusal issued in Japanese Patent Application No. 2017-506746 dated Jul. 23, 2019, all enclosed pages cited.

Decision to Grant issued in Russian Patent Application No. 2017107172/05(012494) dated Sep. 2, 2019, all enclosed pages cited.

* cited by examiner

SELF-CRIMPED RIBBON FIBER AND NONWOVENS MANUFACTURED THEREFROM

CROSS-REFERENCE TO RELATED APPLICATIONS

This patent application claims the priority benefit of U.S. Provisional Application No. 62/034,460 filed on Aug. 7, 2014, the contents of which are incorporated herein by reference.

FIELD OF INVENTION

The present invention relates to a bicomponent fiber having a ribbon shape, specifically a self-crimped bicomponent, ribbon-shaped fiber, and nonwovens manufactured from such fibers.

BACKGROUND

Ribbon bicomponent fibers have conventionally been produced when the fiber is expected to be split into a smaller fiber using mechanical force or by hydroentanglement (e.g., see U.S. Pat. No. 6,627,025 to Yu). The inventors have conceived of using a bicomponent ribbon fiber according to the disclosure provided herein to increase the loft of a nonwoven.

Bulk is often a desirable property for a nonwoven as it transmits a perception of softness and comfort. For example, softness and comfort are desirable for nonwovens used as topsheet or backsheet in diapers. Bulk is also an important characteristic that affects how a nonwoven will absorb, distribute and retain fluids. Good examples are the nonwovens used as an acquisition and distribution layer disposed between the topsheet and the absorbent core of a diaper.

The bulk of a nonwoven may be increased with the use crimped fibers in the manufacture of the nonwoven. Traditionally, a nonwoven produced from staple fibers is to use fibers that have been mechanically crimped prior to cutting the fibers to the appropriate length. Such fibers appear to have a zig-zag shape.

The typical approach for continuous filaments used in the production of bulky spunbond is to make round fibers using two polymer components having differential shrinkage coefficient when reheated and, to position those fibers in a side-by-side or eccentric way. The differences in shrinkage will force the filament to be twisted in a helix shape. An example of this approach is described in U.S. Pat. No. 5,622,772 to Stoke et al. This approach is sometimes referred to as self-crimped filaments. While this approach can produce a nonwoven with an appearance of high loft, the bulk is easily lost when the nonwoven is compressed by a weight. This is due to the crimps offering little resistance to compression as a result of their shape.

Therefore there is a need for a self-crimped bicomponent fiber and the spunbond made from such fibers that resist compression, therefore maintaining some of the benefit of the high bulk even when under load.

BRIEF SUMMARY

The present invention relates to a self-crimped bicomponent fiber having a ribbon shape. Without intending to be bound by theory, the self-crimped bicomponent fibers of the invention and the spunbond nonwovens manufactured from such fibers have improved compression resistance in comparison to conventional fibers and nonwovens.

In one aspect, the invention provides a bicomponent fiber having a ribbon shape. The bicomponent fiber may comprise a first polymer component and a second polymer component, the first polymer component and the second polymer component having either or both a difference in chemistry or physical properties.

In an embodiment of the invention, the first polymer component and the second polymer component having an interface that is substantially parallel to or substantially aligned with a major bisector defining the ribbon shape of the bicomponent fiber. In an embodiment of the invention, the first polymer component and the second polymer component having an interface that is substantially perpendicular to or substantially non-aligned with a major bisector defining the ribbon shape of the bicomponent fiber.

In an embodiment of the invention the bicomponent fiber is self-crimped using at least one of a thermal energy and a mechanical force. Further pursuant to this embodiment, the mechanical force may comprise stretching the bicomponent fiber.

In an embodiment of the invention, an aspect ratio of the bicomponent fiber is greater than about 4:1. In addition to being comprised of different components, the physical properties between the first polymer component and the second polymer component may differ. For example, according to an embodiment of the invention, a melting point difference between the first polymer component and the second polymer component is at most about 15° C.

An aspect of the invention provides a method for preparing a ribbon-shaped bicomponent fiber comprising the steps of providing a first polymer component, providing a second polymer component, spinning and processing the first polymer component and the second polymer component to form the bicomponent fiber having a side-by-side cross-section, and self-crimping the bicomponent fiber to form a self-crimped bicomponent fiber.

In an embodiment of the invention, self-crimping step of the method for preparing a ribbon-shaped bicomponent fiber may comprise either or both of heating thermally or applying a mechanical force.

Another aspect of the invention provides a nonwoven comprising the bicomponent fibers of the invention. In an embodiment of the invention, the bicomponent fibers of the nonwoven have continuous filaments manufactured using a spunbond process. In certain embodiments of the invention, the bicomponent fibers of the nonwoven may be consolidated using thermal bonding and/or entanglement. In certain embodiments of the invention, the bicomponent fibers may comprise staple fibers, and may be consolidated using thermal bonding and/or entanglement, further pursuant to this embodiment of the invention.

Other aspects and embodiments will become apparent upon review of the following description taken in conjunction with the accompanying drawings. The invention, though, is pointed out with particularity by the appended claims.

BRIEF DESCRIPTION OF THE SEVERAL VIEWS OF THE DRAWINGS

Figure 1:
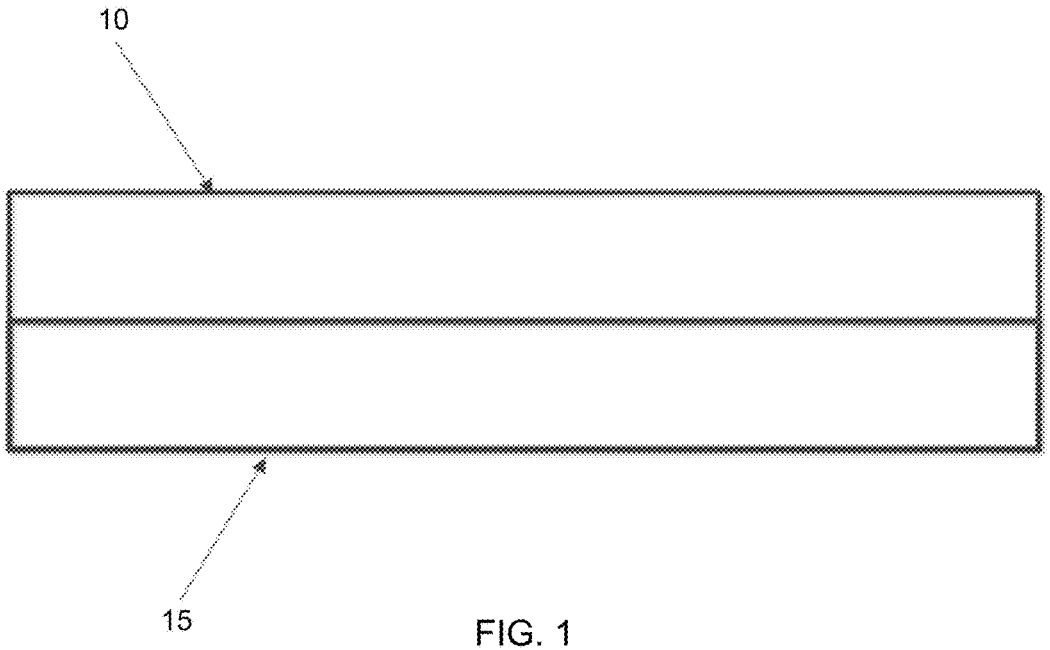
Figure 2:
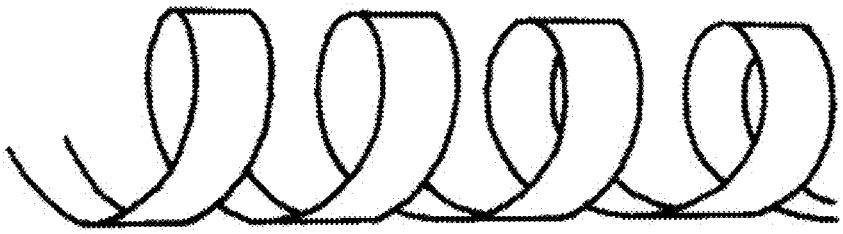
Figure 3:
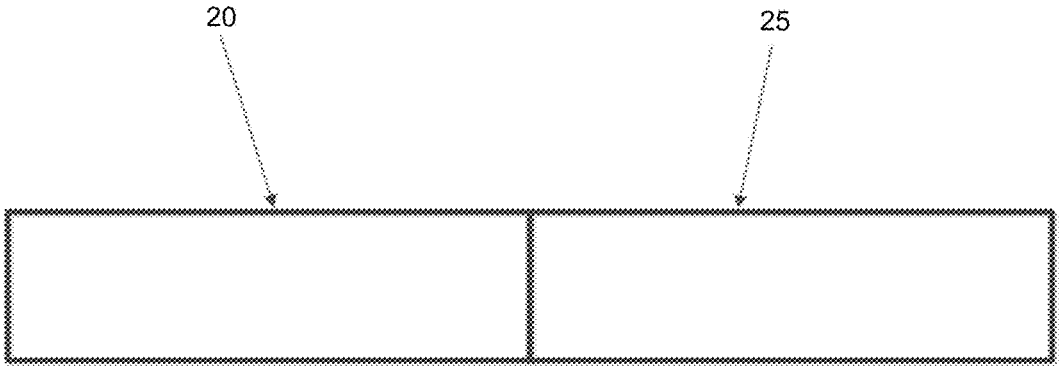
Figure 4:
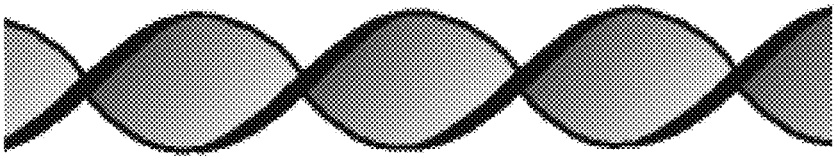
Figure 6A:
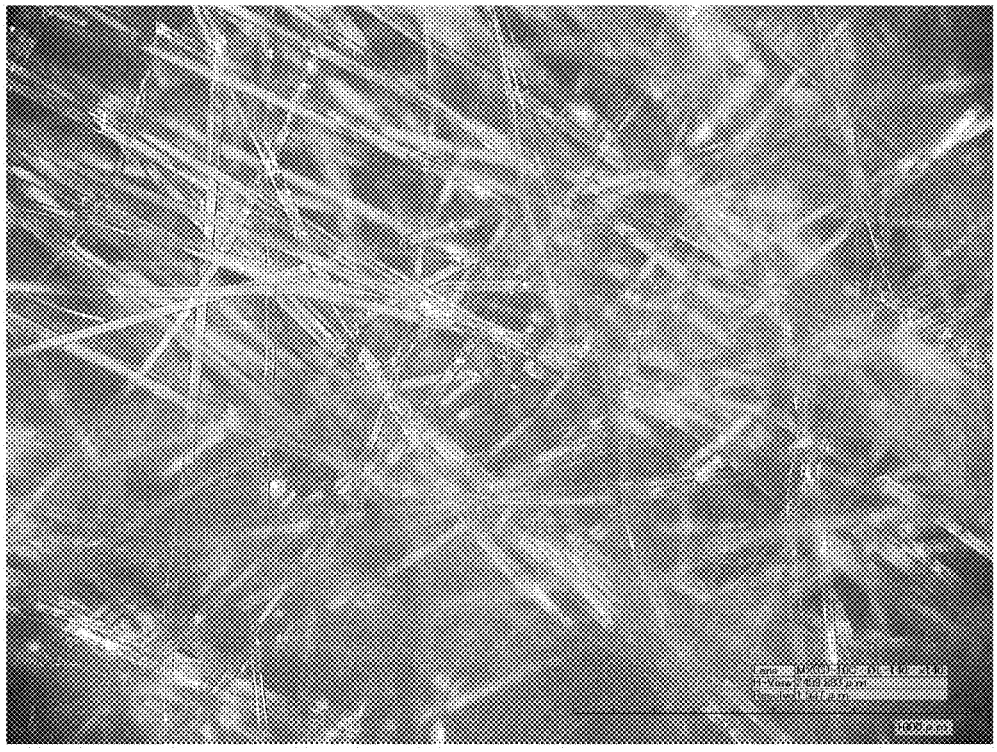
Figure 6B:
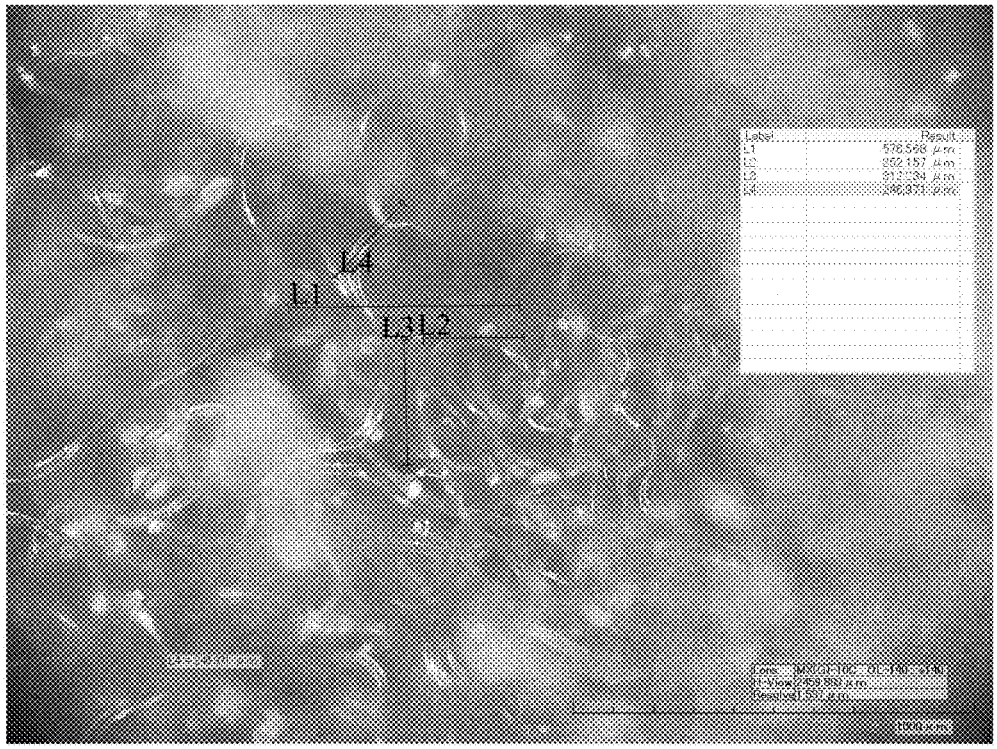
Figure 7:
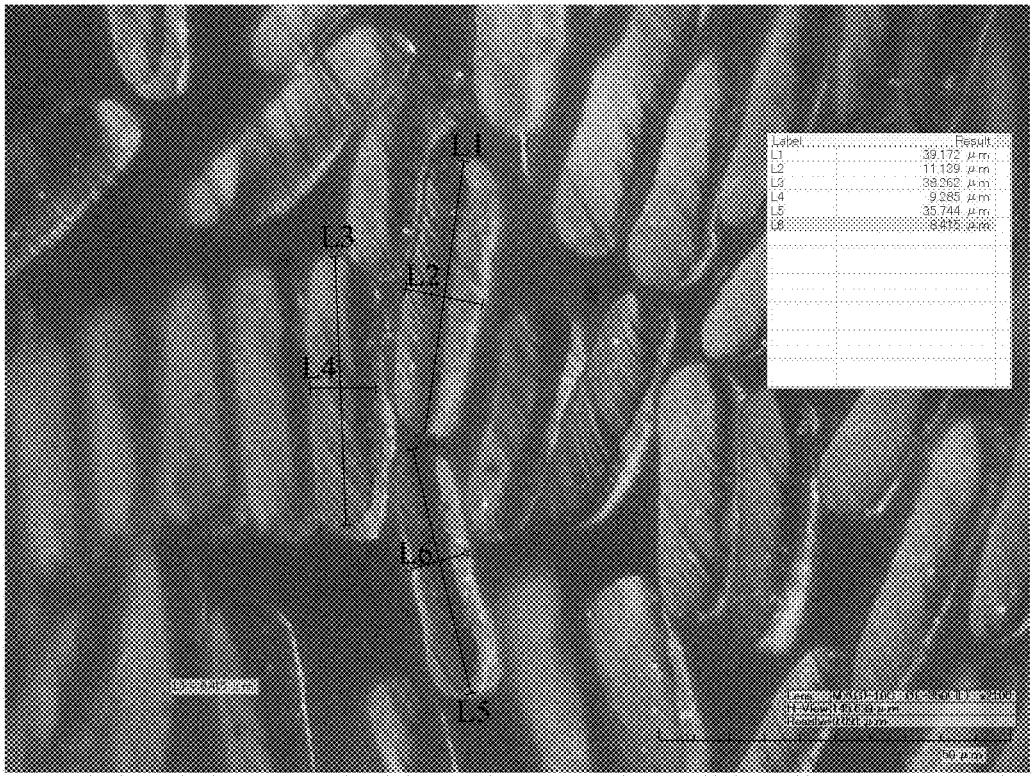

Having thus described the invention in general terms, reference will now be made to the accompanying drawings, which are not necessarily drawn to scale, and wherein:

FIG. 1 is a cross-sectional view of a cut end of a fiber according to an embodiment of the invention;

FIG. 2 is an isometric view of the fiber of FIG. 1 after undergoing heat treatment to trigger its shrinkage according to an embodiment of the invention;

FIG. 3 is a cross-sectional view of a cut end of a fiber according to another embodiment of the invention;

FIG. 4 is an isometric view of the fiber of FIG. 3 after undergoing heat treatment to trigger shrinkage according to another embodiment of the invention;

FIGS. 5A-F illustrate cross-sectional enlarged views of several different shapes of fibers, wherein FIGS. 5A-E showing various ribbon-shaped fibers in accordance with embodiments of the present invention;

FIG. 6A is a SEM of ribbon-shaped fibers in a web that has not been activated according to an embodiment of the invention;

FIG. 6B is a SEM of the ribbon-shaped fibers of FIG. 6A that have been heat activated according to an embodiment of the invention; and FIG. 7 is a SEM of ribbon-shaped bicomponent fibers according to an embodiment of the invention.

DETAILED DESCRIPTION OF THE INVENTION

The present invention now will be described more fully hereinafter with reference to the accompanying drawings, in which some, but not all embodiments of the invention are shown. Preferred embodiments of the invention may be described, but this invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments of the invention are not to be interpreted in any way as limiting of the invention. Like numbers refer to like elements throughout.

As used in the specification and in the appended claims, the singular forms "a", "an", and "the" include plural referents unless the context clearly indicates otherwise. For example, reference to "a fiber" includes a plurality of such fibers.

It will be understood that relative terms, such as "preceding" or "followed by" or the like, may be used herein to describe one element's relationship to another element as, for example, illustrated in the Figures. It will be understood that relative terms are intended to encompass different orientations of the elements in addition to the orientation of elements as illustrated in the Figures. It will be understood that such terms can be used to describe the relative positions of the element or elements of the invention and are not intended, unless the context clearly indicates otherwise, to be limiting.

Embodiments of the present invention are described herein with reference to various perspectives, including perspective views that are schematic representations of idealized embodiments of the present invention. As a person having ordinary skill in the art to which this invention belongs would appreciate, variations from or modifications to the shapes as illustrated in the Figures are to be expected in practicing the invention. Such variations and/or modifications can be the result of manufacturing techniques, design considerations, and the like, and such variations are intended to be included herein within the scope of the present invention and as further set forth in the claims that follow. The articles of the present invention and their respective components illustrated in the Figures are not intended to illustrate the precise shape of the component of an article and are not limited to the scope of the present invention.

Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

The invention is directed to the manufacture of multi-component fibers having a ribbon shape that are capable of self-crimping. Such multi-component fibers are used in the manufacture of nonwovens, according to certain embodiments of the invention.

An aspect of the invention relates to a bicomponent fiber having a ribbon shape. An aspect of the invention described herein also relates to a spunbond manufactured from self-crimped bicomponent fibers having a side by side configuration that has approximately the form of a ribbon shape.

As used herein, "bicomponent fiber" means a fiber or a filament comprising a pair of polymer components substantially aligned and adhered to each other along the length of the fiber. A cross-section of a bicomponent fiber may be, for example, a side-by-side, sheath-core or other suitable cross-section from which useful crimp can be developed. In preferred embodiments of the invention, the cross-section of the bicomponent fiber comprises a substantially side-by-side cross-section.

According to an embodiment of the invention, two polymer components, a first polymer component 10 and a second polymer component 15, having differing properties, such as differential shrinkage coefficients, for example, are positioned in a side-by-side configuration as illustrated in FIG. 1. The fiber or filaments as illustrated in FIG. 1 shrinks in such a way similar to the crimped fiber represented in FIG. 2. According to this embodiment of the invention, such a fiber will shrink in a more predictive way, producing a more compact structure that is more difficult to compress that the regular round self-crimped bicomponent fiber.

According to another embodiment of the invention, the two polymer components a first polymer component 20 and a second polymer component 25 having different properties, such as differential shrinkage coefficients, for example, are positioned in a side-by-side configuration as illustrated in FIG. 3. When heated and shrank the fiber of FIG. 3 will take a helix shape that rotate around the axis corresponding to the interface between the two polymer components similar, for, example, to the crimped fiber represented in FIG. 4. Again, this approach produces a compact structure with good resistance to compression.

Figure 5A:
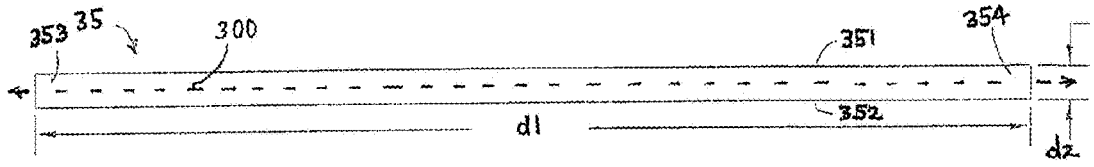

As used herein, the term "ribbon-shaped" refers to a cross-sectional geometry and aspect ratio. With respect to the cross-sectional geometry, "ribbon-shaped" refers to a cross-section that includes at least one pair (set) of symmetrical surfaces. For example, the cross section can be a polygon which includes two different pairs of opposite symmetrical surfaces or only one set thereof. By way of example, but without intending to be limiting, with reference FIG. 5A shows, the overall shape 35 has an imaginary major bisector 300, and a minor bisector (not shown), which is perpendicular to the major bisector, wherein opposite surfaces 351 and 352 are symmetrical surfaces with respect to each other with reference to the imaginary bisector 300. Other ribbon-shape geometries having at least one set of symmetrical surfaces are illustrated, for example, as shown in FIGS. 5B-5E. The major bisector 300 can be straight (e.g., FIGS. 5A-5D), curvilinear (e.g., FIG. 5E), or other shapes, depending on the cross-sectional shape of the fiber. In certain embodiments of the invention, the major bisector 300 may define shape of the "ribbon-shaped" fiber.

In certain embodiments of the invention, a bicomponent fiber comprising a first polymer component and a second polymer component has an interface that is substantially parallel to the major bisector of the "ribbon-shaped" fiber. With respect to a major bisector having a non-linear shape, substantially parallel to means substantially aligned with the general direction of the major bisector. In certain embodiments of the invention, a bicomponent fiber comprising a first polymer component and a second polymer component has an interface that is substantially perpendicular to the major bisector of the "ribbon-shaped" fiber. With respect to a major bisector having a non-linear shape, substantially perpendicular to means substantially non-aligned with the general direction of the major bisector.

Figure 5B:
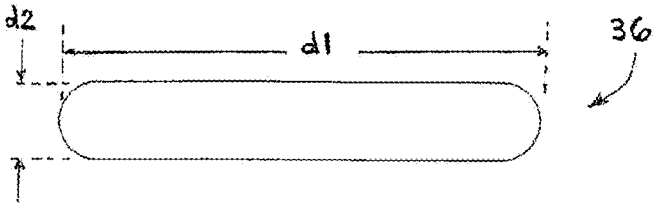
Figure 5C:
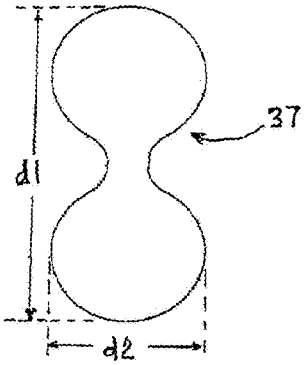
Figure 5D:
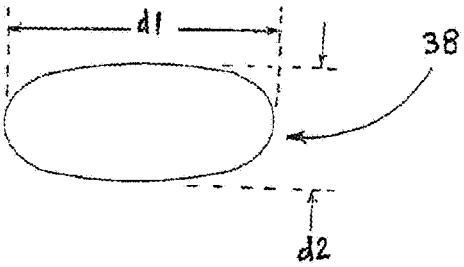
Figure 5E:
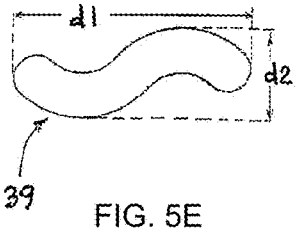
Figure 5F:
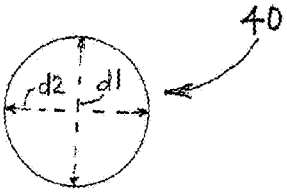

"Ribbon-shaped" may include, for example, a shape having two sets of parallel surfaces forming a rectangular shape (e.g. FIG. 5A). FIG. 5A for example, shows a rectangular cross-sectional geometry 35, which has two longitudinal flat surfaces 351 and 352, and two squared ends 353 and 354. "Ribbon-shaped" may also include, for example, a cross-section having one set of parallel surfaces, which can be joined to one another by shorter rounded end joints 36 having a radius of curvature (e.g., FIG. 5B). "Ribbon-shaped" additionally may include, for example, "dog-bone" shaped cross-sections 37, such as illustrated in FIG. 5C, and oval or elliptical shaped cross-sections 38, such as illustrated in FIG. 5D. In these cross-section illustrated in FIG. 5C, for example, the term "ribbon-shaped" refers to a cross-section that includes sets of symmetrical surfaces that comprise rounded (e.g. curvilinear or lobed) surfaces, that are diametrically oppositely to one another. As illustrated in FIG. 5D, the oval shaped cross-sections can have rounded or curvilinear type top and bottom symmetrical surfaces, which are joined to one another by shorter rounded end joints at the sides having a relatively smaller radius of curvature than the top and bottom symmetrical surfaces The term "ribbon-shaped" also includes cross-sectional geometry that includes no more than two square ends, or round ends, or "lobes" along the perimeter of the cross-section. FIG. 5C, for example, shows a bi-lobal cross section. The lobes differ from the indicated rounded end joints included in the cross-sections such as shown in FIGS. 5B and 5D referred to above. Surface irregularities like bumps or striations or embossed patterns that are relatively small when compared to the perimeter of the cross-section, or are not continuous along the length of the fibers are not included in the definition of "lobes," or the rounded end joints. It can also be understood that the above definition of "ribbon-shaped" covers cross-sectional geometries where one or more of the sets of surfaces (e.g., the opposite lengthwise surfaces) are not straight (e.g. non-straight surfaces as illustrated in FIG. 5E), provided such cross-sectional geometries meet the aspect ratio requirements as defined below.

With respect to aspect ratio, in certain embodiments of the invention, a "ribbon-shaped" cross-section has an aspect ratio (AR) of greater than 1.5:1. The aspect ratio is defined as the ratio of dimension d1 and dimension d2. Dimension d1 is the maximum dimension of a cross-section, whether ribbon-shaped or otherwise, measured along a first axis. Dimension d1 is also referred to as the major dimension of the ribbon-shaped cross-section. Dimension d2 is the maximum dimension of the same cross-section measured along a second axis that is perpendicular to the first axis that is used to measure dimension d1, where dimension d1 is greater than dimension d2. Dimension d2 is also referred to as the minor dimension. As an option, the major bisector 300 can lie along the first axis and the minor bisector (not shown) can lie along the second axis. Examples of how dimensions d1 and d2 are measured are illustrated in FIGS. 5A, 5B, 5C, 5D, and 5E, which illustrate ribbon-shaped cross-sections and in FIG. 5F which illustrates a non-ribbon-shaped cross-section 40 as described below. Aspect ratio is calculated from the normalized ratio of dimensions d1 and d2, according to formula (I):

$$AR=(d1/d2):1 \quad \text{(I)}$$

where the units used to measure d1 and d2 are the same.

The term "ribbon-shaped" excludes for example, cross-sectional shapes that are substantially round, circular or round shaped as defined herein. As referred to herein, the terms "round", "circular" or "round-shaped" refer to fiber cross sections that have an aspect ratio or roundness of 1:1 to 1.5:1. An exactly circular or round fiber cross-section has an aspect ratio 1:1 which is less than 1.5:1. Any fiber that does not meet the indicated criteria for "ribbon-shaped" fiber as defined herein is "non-ribbon shaped". Other non-ribbon shaped fibers may include, for example, square, tri-lobal, quadri-lobal, and penta-lobal cross-sectional shaped fibers. For example, a square shaped cross-section has an aspect ratio of about 1:1, which is less than 1.5:1. A tri-lobal cross-section fiber, for example, has three round ends or "lobes", and thus does not meet the definition for "ribbon-shaped" cross-section, as used herein.

The proportion of a first polymer component to a second polymer component may, in part, determine the area the first polymer component and the area the second polymer component occupies in the cross-section of the bicomponent fiber. In certain embodiments of the invention, the ratio, by weight, of the first polymer component to the second polymer component in the bicomponent fiber may be from about 1:10 to about 10:1, from about 1:5 to about 5:1, from about 1:2 to about 2:1, from about 2:3 to about 3:2, or from about 3:4 to about 4:3. In certain embodiments of the invention, the ratio, by weight, of the first polymer component to the second polymer component in the bicomponent fiber may be around about 1:1 with a +/−10% variation.

For purposes of clarity, the fibers of the invention are distinguished by being both bicomponent and ribbon-shaped. Additionally, the fibers of the invention may be self-crimped.

As used herein, "self-crimped" means to spontaneous crimping exhibited by a fiber upon being subjected to a suitable amount of strain and/or heat and/or other force that may cause the fiber to become crimped.

The polymer component forming the fibers may be comprised of a polymer selected from any thermoplastic polymer or blend of thermoplastic fiber substantially following these conditions: (1) the polymer components are compatible for co-extrusion, meaning that they can be processed at temperatures that are so different as to produce negative effect like the thermal degradation of one of the polymers comprising the polymer component; (2) the polymer components have sufficient compatibility so as to form a stable interface that will survive the shrinkage process (if the adhesion between the polymer components at their interface is too weak, the filament may split into two fibers under the stress induced by the differential shrinkage); and (3) the polymer components selected shrink differently when the fiber is heated and/or some other force is applied to the fiber.

According to an embodiment of the invention, self-crimping may be accentuated by expanding the intrinsic viscosity (IV) difference between the polymers of the two polymer components. The IV of the second component, for example, may be increased by carrying out a solid state polymerization in a manner that widens the gap of crystallizability of the two components. In certain embodiments of the invention, the IV of the first polymer component may be reduced to a level wherein spinning can be possible yet giving increased difference melt viscosities enough to generate fine crimps in the yarn.

U.S. Pat. No. 7,994,081, fully incorporated herein by reference, describes how a crystallizable amorphous thermoplastic polymer may be melt extruded to produce a plurality of fibers. An amorphous thermoplastic polymer, according to the disclosure, possesses sufficiently low or even substantially no crystallinity. Further pursuant to the disclosure, the crystallizable amorphous thermoplastic polymer used for producing the fibers is capable of undergoing stress induced crystallization. During processing, a first component of the polymer composition is subjected to process conditions that result in stress induced crystallization such that the first polymer component is in a semi-crystalline state. A second component of the polymer is processed under conditions that are insufficient to induce crystallization and therefore the second polymer component remains substantially amorphous. Due to its amorphous nature, the second polymer component has a softening temperature below that of the semi-crystalline first polymer component and is thus capable of forming thermal bonds at temperatures below the softening temperature of the first polymer component. Thus, the amorphous second polymer component can be utilized as a binder component of the nonwoven fabric while the semi-crystalline first polymer component can serve as the matrix component of the nonwoven fabric providing the requisite strength physical properties of the fabric such as tensile and tear strength.

Bicomponent fibers of the invention may additionally comprise crystallizable amorphous thermoplastic polymer components. For example, according to an embodiment of the invention, the first and second components can be produced by providing two streams of a molten amorphous polymer in which the polymer from which the second polymer component is formed has a lower intrinsic viscosity than the polymer of the first polymer component. During extrusion, the streams are combined to form a multicomponent fiber. The combined molten streams may then be then subjected to stress that induces crystallization in the higher intrinsic viscosity polymer and is insufficient to induce crystallization in the lower intrinsic viscosity polymer to thereby produce the first and second polymer components, respectively.

In certain embodiments of the invention, the polymer components respectively comprise two polyolefins that are different—in a non-limiting example, a polyethylene and a polypropylene. In an embodiment of the invention, the polyolefins may comprise polyethylene terephthalate/polyethylene (PET/PE), polylactic acid/polyethylene (PLA/PE), or polyethylene terephthalate/polylactic acid (PET/PLA).

In certain embodiments of the invention, the polymer components may comprise copolymers, either in part or as a main polymer component. By way of example, without intending to be limiting, an ethylene polymer may comprise polymers composed mainly of ethylene such as high pressure process polyethylene or medium or low pressure process polyethylene, and may include not only ethylene homopolymers, but copolymers of ethylene, either in part or even as a main component, with propylene, butene-1, vinyl acetate or the like, and any combination thereof.

In an embodiment of the invention, the polymers of the first polymer component and second polymer component may respectively comprise any one or more of an isotactic polymer, a syndiotactic polymer, an isotactic-atactic stereo block polymer, and/or an atactic polymer. For example, without intending to be limiting, the polymers may comprise isotactic polypropylene and syndiotactic polypropylene, respectively, or polyethylene having different densities or tacticities, when applicable.

Pursuant to certain embodiments of the invention where the polymers of either or both polymer compositions comprise polyethylene, the polyethylene may be a linear, semi-crystalline homopolymer of ethane, e.g., high density polyethylene (HDPE); a random copolymer of ethylene and alpha-olefins, e.g., a linear low-density polyethylene (LLDPE); a branched ethylene homopolymer, e.g., a low density polyethylene (LDPE) or very low density polyethylene (VLDPE); an elastomeric polyolefin, e.g., a copolymer of propylene and alpha olefin; and any combination thereof.

In an embodiment of the invention, the polymers of the polymer components may be the same type of polymer but have different number average molecular weights. For example, the number average molecular weight of a first polymer of the first polymer component may be at least about 10,000, at least about 50,000, at least about 100,000, or at least about 500,000, alternatively, up to about 500,000, up to about 100,000, up to about 50,000, or up to about 10,000. The number average molecular weight of a second polymer of the second polymer component may be at least about 5,000, at least about 10,000, at least about 50,000, at least about 100,000, or at least about 500,000, alternatively, up to about 500,000, up to about 100,000, up to about 50,000, up to about 10,000 or up to about 5,000. However, the number average molecular weight of the first polymer differs from the number average molecular weight of the second polymer. The number average molecular weight of the first polymer may differ from the number average molecular weight of a second polymer by up to about 500, up to about 1,000, up to about 2,000, up to about 2,500, up to about 3,500, up to about 5,000, up to about 7,500, up to about 10,000, up to about 15,000, up to about 25,000, up to about 30,000, up to about 35,000, up to about 40,000, up to about 45,000, up to about 50,000, up to about 60,000, up to about 70,000, up to about 75,000, up to about 90,000, up to about 100,000, up to about 125,000, up to about 150,000, up to about 175,000, up to about 200,000, or up to about 250,000.

In an embodiment of the invention, in addition to the first polymer of the first polymer component and the second polymer of a second polymer component, either or both of the first polymer component and the second polymer component may include another polymer to form a polymer blend. In the case when both polymer components include such another polymer, this polymer is of the same polymer type but has different properties. An example of such use of a polymer blend in the components of a multicomponent fiber is described in U.S. Pat. No. 8,758,660, fully incorporated herein by reference. For example, this other polymer included in the polymer blends may have different number average molecular weights in each of the polymer blends for the first polymer component and the second polymer component, respectively. For example, the number average molecular weight of this polymer in the polymer blend of the first polymer component may be at least about 200, at least about 500, at least about 1,000, or at least about 1,500, alternatively, up to about 5,000, up to about 3,500, up to about 3,000, or up to about 2,500. When this additional polymer is included in the second polymer component, the number average molecular weight of this polymer in the polymer blend of the second polymer component may be at least about 200, at least about 500, at least about 1,000, or at least about 1,500, alternatively, up to about 5,000, up to about 3,500, up to about 3,000, or up to about 2,500. However, the number average molecular weight of the first polymer differs from the number average molecular weight of the second polymer. The number average molecular weight of the polymer in the first polymer blend may differ from the number average molecular weight of the polymer in the second polymer blend by up to about 5, up to about 10, up to about 20, up to about 25, up to about 35, up to about 50, up to about 75, up to about 100, up to about 150, up to about 250, up to about 300, up to about 350, up to about 400, up to about 450, up to about 500, up to about 600, up to about 700, up to about 750, up to about 900, up to about 1,000, up to about 1,250, up to about 1,500, up to about 1,750, up to about 2,000, or up to about 2,500.

In an embodiment of the invention, the polymer of the polymer component may comprise a multicomponent polymer. As used herein, "multicomponent" may include a copolymers, a terpolymer, a tetrapolymer, etc., and any combination thereof. According to an embodiment of the invention, the multicomponent fiber is configured to provide the bicomponent fiber with a capability to become self-crimped such that its use in nonwovens provide for an increased bulk relative to bicomponent fibers that do not include such multicomponent fiber or fibers.

The melting points of the polymer components may be configured to be approximately the same of different depending upon whether crimping with be accomplished through heat; some other mechanical force, such as hydroentangling, drawing, and the like; or combinations thereof. Indeed, any crimping process known in the art may be used.

In certain embodiments of the invention, the first polymer component may have a melting point in a range of from about 110° C. to about 130° C., for example. In an embodiment of the invention, the melting point of the second polymer component may be in a range from about 135° C. to about 175° C., from about 145° C. to about 170° C., from about 150° C. to about 168° C., or from about 160° C. to about 166° C. In certain embodiments of the invention, the melting point difference between the first polymer component and the second polymer component is up to about 1° C., up to about 2° C., up to about 3° C., up to about 4° C., up to about 5° C., up to about 10° C., up to about 15° C., up to about 20° C., up to about 25° C., up to about 30° C., up to about 40° C., or up to about 50° C.

The polymer components may additionally comprise one or more additives and/or compatibilizers to enhance the adhesion at the interface between the polymer components.

In an embodiment of the invention, the activation of the latent shrinkage of the polymer component may be initiated on the fiber prior to the formation into a web; or on the web prior to its consolidation, in another embodiment of the invention. In certain other embodiments of the invention, it is also possible to activate the fiber with heat after consolidation by hydroentanglement or point bonding, for example.

FIG. 6A is a SEM of ribbon-shaped fibers in a web that has not been activated according to an embodiment of the invention. FIG. 6B is a SEM of the ribbon-shaped fibers of FIG. 6A that have been heat activated according to an embodiment of the invention. The ribbon-shaped fibers of FIG. 6B have become crimped as a result of heat activation. FIG. 7 is a SEM of ribbon-shaped bicomponent fibers according to an embodiment of the invention. The bicomponent ribbon-shaped fibers of FIGS. 6A, 6B and 7 are side-by-side bicomponent fibers comprising a polyethylene terephthalate (PET) on one side and a PET copolymer on the other side. Of course, any polymer combination is possible, as further disclosed herein. For example, a non-limiting example of a preferred embodiment of the invention, is a side-by-side bicomponent ribbon-shaped fiber having a polypropylene (PP) on one side and a polyethylene (PE) on the other side.

The ribbon fibers of FIG. 6A have been consolidated using thermal energy as the crimped fibers of FIG. 6B demonstrate. Table 1 provides the lengths of several ribbon-shaped fibers of FIG. 6B after undergoing heat activation.

TABLE 1

Crimped Length of Fibers in FIG. 6B

| Parameter | Description | Value, μm |
|---|---|---|
| L1 | Crimped Length of Fiber 1 | 576.568 |
| L2 | Crimped Length of Fiber 2 | 252.157 |
| L3 | Crimped Length of Fiber 3 | 312.234 |
| L4 | Crimped Length of Fiber 4 | 246.971 |
| | Average Crimped Length | 346.983 |

Table 2 provides the major dimensions and minor dimensions of several ribbon-shaped fibers of FIG. 7.

TABLE 2

Dimensions of Fibers in FIG. 7

| Parameter | Description | Value, μm | Aspect Ratio |
|---|---|---|---|
| L1 | Major Dimension of Fiber 1 | 39.172 | 3.517 |
| L2 | Minor Dimenstion of Fiber 1 | 11.139 | |
| L3 | Major Dimension of Fiber 2 | 38.262 | 4.121 |
| L4 | Minor Dimension of Fiber 2 | 9.285 | |
| L5 | Major Dimension of Fiber 3 | 35.744 | 4.248 |
| L6 | Minor Dimension of Fiber 3 | 8.415 | |
| Average Major Dimension of Fibers | | 37.726 | 3.924 |
| Average Minor Dimension of Fibers | | 9.613 | |

The bicomponent fibers of the invention may have an aspect ratio of greater than about 1.5:1, greater than about 2:1, greater than about 2.5:1, greater than about 3:1, greater than about 4:1 and greater than about 5:1.

The nonwoven manufactured from the fibers of the invention may be formed by any method known in the art. However, in a preferred embodiment of the invention, spunbond fabrics are manufactured from continuous filaments of the invention.

The terms "nonwoven" or "nonwoven fabric" or "fabric," as may be used interchangeably herein, refers to a nonwoven collection of polymer fibers or filaments in a close association to form one or more layers. The one or more layers of the nonwoven or nonwoven fabric or fabric may include staple length fibers, substantially continuous or discontinuous filaments or fibers, and combinations or mixtures thereof, unless specified otherwise. The one or more layers of the nonwoven fabric or nonwoven component can be stabilized or unstabilized.

The fabric of the invention can be woven, knitted, or nonwoven, but hydroentangled nonwoven fabrics are preferred according to certain embodiments of the invention. In certain embodiments of the invention, it is particularly preferred to manufacture fabrics of the invention using thermally treated self-crimped ribbon-shaped fibers. Further pursuant to these embodiments, hydroentanglement may follow the thermal treatment and/or mechanical force needed to crimp the bicomponent fibers of the invention. According to an embodiment of the invention, the bicomponent fibers, formed into a spunbonded web may be subjected to water pressure from one or more hydroentangling stations at a water pressure in the range of 10 bar to 1000 bar. The nonwoven fabric may additionally be subjected to thermal heating to further crimp the bicomponent fibers in the spunbonded web, according to certain embodiments of the invention.

According to an embodiment of the invention, the fabric may be stretched in the machine direction during to induce crimping of the bicomponent fibers within the fabric. Alternatively or additionally, the fabric may be stretched in the cross direction to induce crimping in the bicomponent fibers of the fabric. In certain embodiments, the fabric may be stretched in the cross direction by employing a tenterframe to form machine-wise stretch for bicomponent fiber crimp inducement.

In certain embodiments of the invention, a nonwoven comprises the bicomponent fibers of the invention. Further pursuant to the embodiment, the bicomponent fibers of the nonwoven may include continuous filaments manufactured by a spunbond process. In certain embodiments of the invention, the bicomponent fibers of the nonwonven may be consolidated using at least one of thermal bonding and entanglement.

An aspect of the invention provides a process for preparing a bicomponent fiber. The process for preparing a bicomponent fiber comprises the steps of providing as a first polymer component, providing a second polymer component, and spinning and processing the first polymer component and the second polymer component to form the bicomponent fiber having a side-by side cross-section.

Bicomponent fibers of the invention may be prepared, according to certain embodiments, with spinnerets that are designed for producing a bicomponent filament of the desired cross-sectional configuration—e.g., side-by-side cross-section in a preferred embodiment of the invention. The spinnerets may be configured to form bicomponent filaments at all of the spinneret orifices, or alternatively, depending upon the particular product characteristics desired, the spinnerets may be configured to produce some bicomponent multilobal filament and some multilobal filaments formed entirely of one of the first and second polymer components.

Many modifications and other embodiments of the invention set forth herein will come to mind to one skilled in the art to which this invention pertains having the benefit of the teachings presented in the descriptions herein and the associated drawings. It will be appreciated by those skilled in the art that changes could be made to the embodiments described herein without departing from the broad invention concept thereof. Therefore, it is understood that this invention is not limited to the particular embodiments disclosed, but it is intended to cover modifications within the spirit and scope of the present invention as defined by the appended claims.

That which is claimed:

1. A bicomponent fiber comprising:

a continuous self-crimped bicomponent fiber manufactured by a spunbond process and having a rectangular-shaped cross-section and one or more three-dimensional crimps, wherein the continuous self-crimped bicomponent fiber includes a first polymer component and a second polymer component, wherein an aspect ratio of the continuous self-crimped bicomponent fiber is 3.5:1 or greater, and wherein the continuous self-crimped bicomponent fiber is produced upon subjecting a non-crimped rectangular-shaped bicomponent fiber to at least one of a thermal energy and a mechanical force.

2. The bicomponent fiber according to claim 1, wherein the first polymer component and the second polymer component having an interface that is substantially parallel to a major bisector defining the rectangular-shaped cross-section of the continuous self-crimped bicomponent fiber.

3. The bicomponent fiber according to claim 1, wherein the first polymer component and the second polymer component having an interface that is substantially perpendicular to a major bisector defining the rectangular-shaped cross-section of the continuous self-crimped bicomponent fiber.

4. The bicomponent fiber according to claim 1, wherein the mechanical force comprises stretching the non-crimped rectangular-shaped bicomponent fiber.

5. The bicomponent fiber according to claim 1, wherein the aspect ratio of the continuous self-crimped bicomponent fiber is greater than 4:1.

6. The bicomponent fiber according to claim 1, wherein a melting point difference between the first polymer component and the second polymer component is at most 15° C.

7. A spunbond nonwoven, comprising:

a plurality of continuous self-crimped bicomponent fibers manufactured by a spunbond process and having a rectangular-shaped cross-section and one or more three-dimensional crimps, wherein the continuous self-crimped bicomponent fibers include a first polymer component and a second polymer component;

wherein an aspect ratio of the continuous self-crimped bicomponent fibers is 3.5:1 or greater, and wherein the continuous self-crimped bicomponent fibers are produced upon subjecting rectangular-shaped bicomponent fibers to at least one of a thermal energy and a mechanical force.

8. The nonwoven according to claim 7, wherein the plurality of continuous self-crimped bicomponent fibers are consolidated using at least one of a thermal bond and entanglement.

9. The nonwoven according to claim 7, wherein the first polymer component and the second polymer component having an interface that is substantially parallel to a major bisector defining the rectangular shape of the bicomponent fiber.

10. The nonwoven according to claim 9, wherein an aspect ratio of the continuous self-crimped bicomponent fibers is greater than 4:1.

11. The nonwoven according to claim 7, wherein the first polymer component and the second polymer component having an interface that is substantially perpendicular to a major bisector defining the rectangular-shaped cross-section of the continuous spunbond self-crimped bicomponent fiber.

12. The bicomponent fiber according to claim 11, wherein an aspect ratio of the continuous self-crimped bicomponent fibers is greater than about 4:1.

13. The nonwoven according to claim 7, wherein the mechanical force comprises stretching the non-crimped rectangular-shaped bicomponent fibers.

14. The nonwoven according to claim 7, wherein a melting point difference between the first polymer component and the second polymer component is at most about 15° C.

15. The bicomponent fiber according to claim 1, wherein the one or more three-dimensional crimps comprise at least one loop portion extending in a z-direction.

16. The bicomponent fiber according to claim 1, wherein the first polymer component, the second polymer component, or both comprise a polyolefin.

17. The bicomponent fiber according to claim 16, wherein the first polymer component comprises a first polyolefin and the second polymer component comprises a second polyolefin, wherein the first polyolefin is different than the second polyolefin.

* * * * *